US011684840B2

(12) United States Patent
Downey et al.

(10) Patent No.: US 11,684,840 B2
(45) Date of Patent: Jun. 27, 2023

(54) WEIGHT STACK ISOLATOR AND SELECTORIZED MACHINE INCORPORATING THE SAME

(71) Applicant: PLITEQ INC., Vaughan (CA)

(72) Inventors: Paul Downey, Vaughan (CA); Paul Gartenburg, Vaughan (CA)

(73) Assignee: PLITEQ INC., Vauglan (CA)

( * ) Notice: Subject to any disclaimer, the term of this patent is extended or adjusted under 35 U.S.C. 154(b) by 193 days.

(21) Appl. No.: 17/181,488

(22) Filed: Feb. 22, 2021

(65) Prior Publication Data

US 2021/0170256 A1 Jun. 10, 2021

Related U.S. Application Data

(63) Continuation of application No. 15/958,287, filed on Apr. 20, 2018, now Pat. No. 10,926,153.

(51) Int. Cl.

| | |
|---|---|
| ***A63B 71/00*** | (2006.01) |
| ***A63B 21/062*** | (2006.01) |
| *A63B 21/06* | (2006.01) |

(52) U.S. Cl.

CPC ..... *A63B 71/0054* (2013.01); *A63B 21/063* (2015.10); *A63B 21/06* (2013.01); *A63B 21/062* (2013.01); *A63B 21/0607* (2013.01); *A63B 21/0626* (2015.10); *A63B 21/0628* (2015.10); *A63B 21/0632* (2015.10); *A63B 2071/0063* (2013.01)

(58) Field of Classification Search

CPC ... A63B 21/06; A63B 21/0607; A63B 21/062; A63B 21/0626; A63B 21/0628; A63B 21/063; A63B 21/0632; A63B 71/0054; A63B 2071/0063

See application file for complete search history.

(56) References Cited

U.S. PATENT DOCUMENTS

| | | | | | |
|---|---|---|---|---|---|
| 3,635,472 | A * | 1/1972 | Marcyan | A63B 21/06 | 482/101 |
| 3,815,903 | A * | 6/1974 | Blomqvist | A63B 21/06 | 482/103 |
| 3,912,263 | A * | 10/1975 | Yatso | A63B 21/063 | 482/99 |
| 4,111,414 | A * | 9/1978 | Roberts | A63B 1/00 | 482/102 |
| 4,322,071 | A * | 3/1982 | Lambert, Jr. | A63B 21/155 | 482/100 |
| 4,606,540 | A * | 8/1986 | Chin-Sen | A63B 21/0632 | 482/99 |

(Continued)

*Primary Examiner* — Joshua Lee

(74) *Attorney, Agent, or Firm* — Faegre Drinker Biddle & Reath LLP

(57) ABSTRACT

A weight stack isolator comprises an impact damper having a rail void therein configured to receive a guide rail of a selectorized machine. The impact damper is shaped to at least partially surround a section of the guide rail when received in the rail void, to secure the weight stack isolator to the selectorized machine. The weight stack isolator may include a slit extending from its outer perimeter to the rail void or the rail void may extend to the outer perimeter, to removably receive the guide rail in the rail void. The weight stack isolator can be positioned under a weight stack of the selectorized machine to absorb or dampen noise and vibration.

13 Claims, 12 Drawing Sheets

(56) References Cited

U.S. PATENT DOCUMENTS

| | | | | | |
|---|---|---|---|---|---|
| 4,621,807 | A * | 11/1986 | Stramer | A63B 21/06 | 482/100 |
| 4,974,837 | A * | 12/1990 | Someya | A63B 21/0628 | 482/112 |
| 5,306,221 | A * | 4/1994 | Itaru | A63B 21/0628 | 482/97 |
| 5,342,271 | A * | 8/1994 | Long | A63B 21/063 | 482/98 |
| 6,126,579 | A * | 10/2000 | Lin | A63B 21/063 | 482/99 |
| 6,224,519 | B1 * | 5/2001 | Doolittle | A63B 21/063 | 482/99 |
| 6,575,882 | B2 * | 6/2003 | Chen | A63B 21/0628 | 482/99 |
| 9,079,068 | B2 * | 7/2015 | Muehl | A63B 21/078 | |
| 9,186,537 | B2 * | 11/2015 | Arnold | A63B 21/063 | |
| 2005/0245369 | A1 * | 11/2005 | Vigiano | A63B 21/0628 | 482/94 |
| 2013/0217548 | A1 * | 8/2013 | Muehl | A63B 21/0628 | 482/98 |

* cited by examiner

WEIGHT STACK ISOLATOR AND SELECTORIZED MACHINE INCORPORATING THE SAME

CROSS-REFERENCE TO RELATED APPLICATION

The present application is a divisional of U.S. application Ser. No. 15/958,287, filed Apr. 20, 2018, the subject matter of which is expressly incorporated herein by reference.

BACKGROUND

1. Field of the Disclosure

The present disclosure relates generally to selectorized machines, and more particularly to a weight stack isolator for placing under at least a portion of a weight stack of a selectorized machine and to a selectorized machine incorporating the weight stack isolator.

2. Description of the Related Art

Selectorized machines provide the benefit of selectable resistance while exercising. This flexibility allows a single machine to provide adjustable difficulty to accommodate varying user needs. A typical selectorized machine includes a frame supporting a cable and pulley system, guide rails and a weight stack. The weight stack travels along the guide rails and provides resistance, which is then transmitted by the cable and pulley system to a user during exercises. The weight stack will typically include a plurality of weight plates that can be selectively engaged with the pulley system to adjust resistance.

During exercises, the user raises and lowers the engaged weight plates using the cable and pulley system. However, if the weight plates are released prematurely or lowered abruptly, the resulting impact of the engaged weight plates on the unengaged remainder of the weight stack, or on the frame of the selectorized machine, can result in significant noise and vibration. This noise and vibration can propagate into and through the surrounding building structure to nearby areas such as adjacent rooms or floors, which is often undesirable. This noise and vibration can be particularly significant in buildings that were not originally designed to dampen such noise and vibration, such as in buildings that were retrofitted to include workout facilities. Accordingly, options for damping weight plate impacts in selectorized machines are generally desired.

It is therefore an object to provide a novel weight stack isolator and selectorized machine incorporating the same.

SUMMARY

The present disclosure provides a selection of concepts in a simplified form that are further described below in the detailed description. This summary is not intended to be used to limit the scope of the claimed subject matter.

In one aspect there is provided a weight stack isolator for positioning under at least a portion of a weight stack of a selectorized machine, the weight stack isolator comprising: an impact damper having at least one rail void therein configured to receive at least one guide rail of the selectorized machine, the impact damper being shaped to at least partially surround a section of the at least one guide rail when received in the at least one rail void, to secure the weight stack isolator to the selectorized machine.

In some embodiments, the impact damper may comprise a damping layer and an overlying impact layer. The damping layer and the impact layer may have similar footprints. The impact layer may be formed of resilient rubber, may have a thickness of generally 8 mm and may have a weight of generally 77 kg per 9 $m^2$. The damping layer may be formed of a low dynamic modulus elastomer, may have a thickness of generally 50 mm, may have a weight of generally 7 kg per 2 $m^2$, and may have a durometer of generally 10.

In some embodiments, the impact damper may be shaped to completely surround the section of the at least one guide rail when received in the at least one rail void. The impact damper may have at least one slit extending from an outer perimeter of the impact damper to the at least one rail void. The weight stack isolator may further comprise a bearing plate underlying the impact damper, the bearing plate may have at least one plate void therein extending inwardly from an outer perimeter of the bearing plate in alignment with the at least one slit and the at least one rail void. The bearing plate may be formed of steel and may have a thickness of generally 3 mm. In some embodiments, the at least one guide rail may comprise a plurality of guide rails, the at least one rail void may comprise a plurality of rail voids, each of the rail voids being configured to receive a corresponding one of the guide rails, and the at least one slit may comprise a plurality of slits, each of the slits extending from the outer perimeter of the impact damper to a respective one of the rail voids.

In some embodiments, the impact damper may be shaped to partially surround the section of the at least one guide rail when received in the at least one rail void, the at least one rail void may extend inwardly from an outer perimeter of the impact damper and the at least one rail void may be configured to removably receive the at least one guide rail. The weight stack isolator may further comprise a bearing plate underlying the impact damper, the bearing plate may have at least one plate void extending inwardly from an outer perimeter of the bearing plate in alignment with the at least one rail void. The bearing plate may be formed of steel and may have a thickness of generally 3 mm. In some embodiments, the at least one guide rail may comprise a plurality of guide rails and the at least one rail void may comprise a plurality of rail voids, each of the rail voids being configured to receive a corresponding one of the guide rails and each of the rail voids extending inwardly from the outer perimeter of the impact damper.

In some embodiments, the weight stack isolator may have a generally similar footprint to that of the bottommost weight in the weight stack. The weight stack isolator may have a selector rod void therein extending at least partially therethrough for receiving a selector rod of the selectorized machine.

In one form thereof, the present invention provides a selectorized machine including: a weight stack; at least one guide rail for guiding the weight stack; and a weight stack isolator, as defined in the above summary, positioned under at least a portion of the weight stack.

In another form thereof, the present invention provides a weight stack isolator for positioning under at least a portion of a weight stack of a selectorized machine, the weight stack isolator including an impact damper having at least one rail void therein configured to receive at least one guide rail of the selectorized machine, the impact damper being shaped to at least partially surround a section of the at least one guide rail when received in the at least one rail void, to secure the weight stack isolator to the selectorized machine.

BRIEF DESCRIPTION OF THE DRAWINGS

The above-mentioned and other features of the disclosure, and the manner of attaining them, will become more apparent and will be better understood by reference to the following description of embodiments of the disclosure taken in conjunction with the accompanying drawings, wherein.

Corresponding reference characters indicate corresponding parts throughout the several views. The exemplifications set out herein illustrate embodiments of the disclosure and such exemplifications are not to be construed as limiting the scope of the invention in any manner.

DETAILED DESCRIPTION

Figure 1:
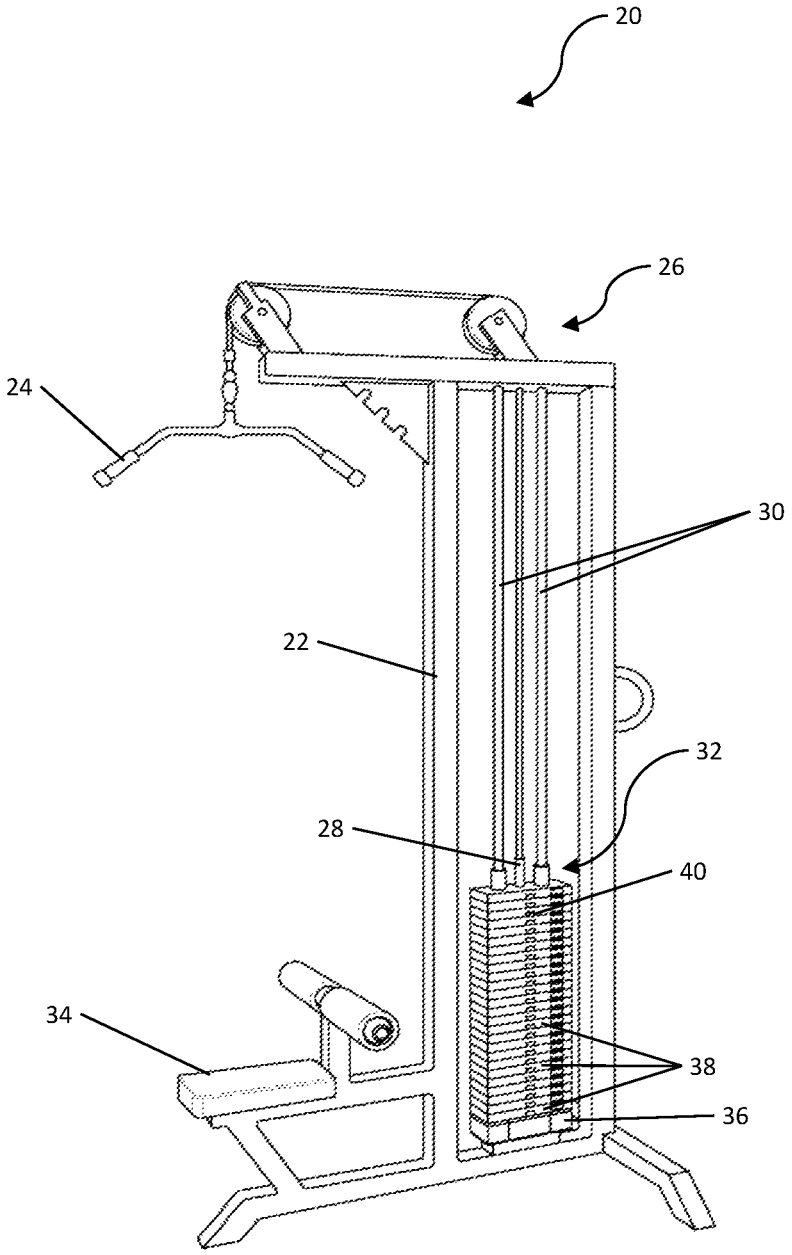
FIG. 1 is a perspective view of a selectorized machine with an installed weight stack isolator.

The foregoing summary, as well as the following detailed description of certain embodiments will be better understood when read in conjunction with the appended drawings. As used herein, an element or feature introduced in the singular and preceded by the word "a" or "an" should be understood as not necessarily excluding the plural of the elements or features. Further, references to "one example" or "one embodiment" are not intended to be interpreted as excluding the existence of additional examples or embodiments that also incorporate the described elements or features. Moreover, unless explicitly stated to the contrary, examples or embodiments "comprising" or "having" or "including" an element or feature or a plurality of elements or features having a particular property may include additional elements or features not having that property. Also, it will be appreciated that the terms "comprises", "has", "includes" means "including by not limited to" and the terms "comprising", "having" and "including" have equivalent meanings.

As used herein, the terms "adapted" and "configured" mean that the element or feature is designed and/or intended to perform a given function. Thus, the use of the terms "adapted" and "configured" should not be construed to mean that a given element or feature is simply "capable of" performing a given function but that the element or feature is specifically selected, created, implemented, utilized, and/or designed for the purpose of performing the function. Also, elements or features that are described as being adapted or operative to perform a particular function may additionally or alternatively be described as being configured to perform that function, and vice versa.

As used herein, the term "and/or" can include any and all combinations of one or more of the associated listed elements or features.

It will be understood that when an element or feature is referred to as being "on", "attached" to, "connected" to, "coupled" with, "contacting", etc. another element or feature, that element or feature can be directly on, attached to, connected to, coupled with or contacting the other element or feature or intervening elements may also be present. In contrast, when an element or feature is referred to as being, for example, "directly on", "directly attached" to, "directly connected" to, "directly coupled" with or "directly contacting" another element of feature, there are no intervening elements or features present.

It will be understood that spatially relative terms, such as "under", "below", "lower", "over", "above", "upper", "front", "back" and the like, may be used herein for ease of description to describe the relationship of an element or feature to another element or feature as illustrated in the figures. The spatially relative terms can however, encompass different orientations in addition to the orientation depicted in the figures.

Unless defined otherwise, all technical and scientific terms used herein have the same meaning as is commonly understood by one of ordinary skill in the art to which the subject disclosure pertains.

In the following, exemplary weight stack isolators and an exemplary selectorized machine incorporating the same are described. Broadly, the weight stack isolators comprise an impact damper defining at least one rail void configured to receive at least one guide rail of the selectorized machine. The impact damper is shaped to at least partially surround a section of the at least one guide rail when received in the at least one rail void, to secure the weight stack isolator to the selectorized machine. Particular non-limited examples of the weight stack isolators and a selectorized machine incorporating the same will now be described.

FIG. 1 illustrates a selectorized machine generally identified by reference character 20. The selectorized machine 20 comprises a frame 22, an exercise feature 24 (in this embodiment, a pull-down bar), a cable and pulley system 26, a selector rod 28, guide rails 30 and a weight stack 32. The selectorized machine also includes a seat 34 and may optionally comprise other accessories. A weight stack isolator 36 is installed on the selectorized machine 20 under the weight stack 32. The frame 22 supports the guide rails 30, the weight stack 32, the selector rod 28 and the weight stack isolator 36 in vertical alignment. The frame 22 further supports the exercise feature 24, the cable and pulley system 26 and the seat 34 in proximity to the weight stack 32. The weight stack 32 comprises a plurality of weights in the form of plates 38, and the weight stack isolator 36 is positioned under the bottommost plate 38 of the weight stack 32. Each plate 38 can be selectively coupled with the selector rod 28 by inserting a selector pin 40 through aligned holes in the plate 38 and selector rod 28. The selector rod 28 is connected to one end of the cable and pulley system 26 adjacent the weight stack 32, while the opposite end of the cable and pulley system 26 is connected to the exercise feature 24. Accordingly, the plates 38 in the weight stack 32 can be selectively engaged or disengaged with the selector rod 28 to vary the resistance on the exercise feature 24. As will be appreciated, the embodiment of the selectorized machine 20 shown in FIG. 1 is intended to be illustrative and other selectorized machine configurations and embodiments will be apparent to those skilled in the art. For example, the selectorized machine may comprise a single guide rail or more than two guide rails. In some embodiments the plates 38 in the weight stack 32 may be disks or other shapes or configurations of weights.

During use, a user selectively engages a number of the plates 38 with the selector rod 28 to provide a desired amount of resistance on the exercise feature 24 and then interacts with the exercise feature 24 to raise and lower the engaged plates 38 along the guide rails 30 via the cable and pulley system 26 and the selector rod 28. As the engaged plates 38 are lowered and impact either the remaining unengaged plates 38 or the weight stack isolator 36 directly, the weight stack isolator 36 absorbs or dampens the impact to reduce noise and vibration that is transmitted into the surrounding environment, especially through the frame 22.

Figure 2:
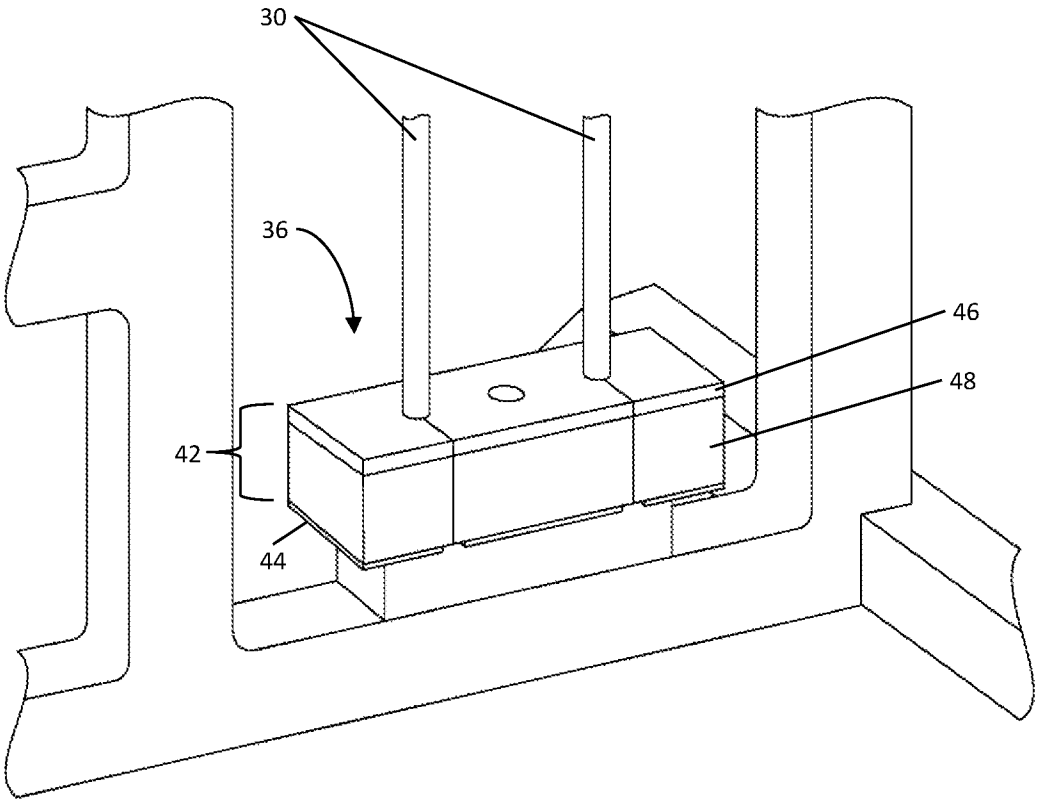
FIG. 2 is a fragmentary view of the selectorized machine of FIG. 1, focusing on the weight stack isolator and with the weight stack and selector rod omitted.
Figure 3:
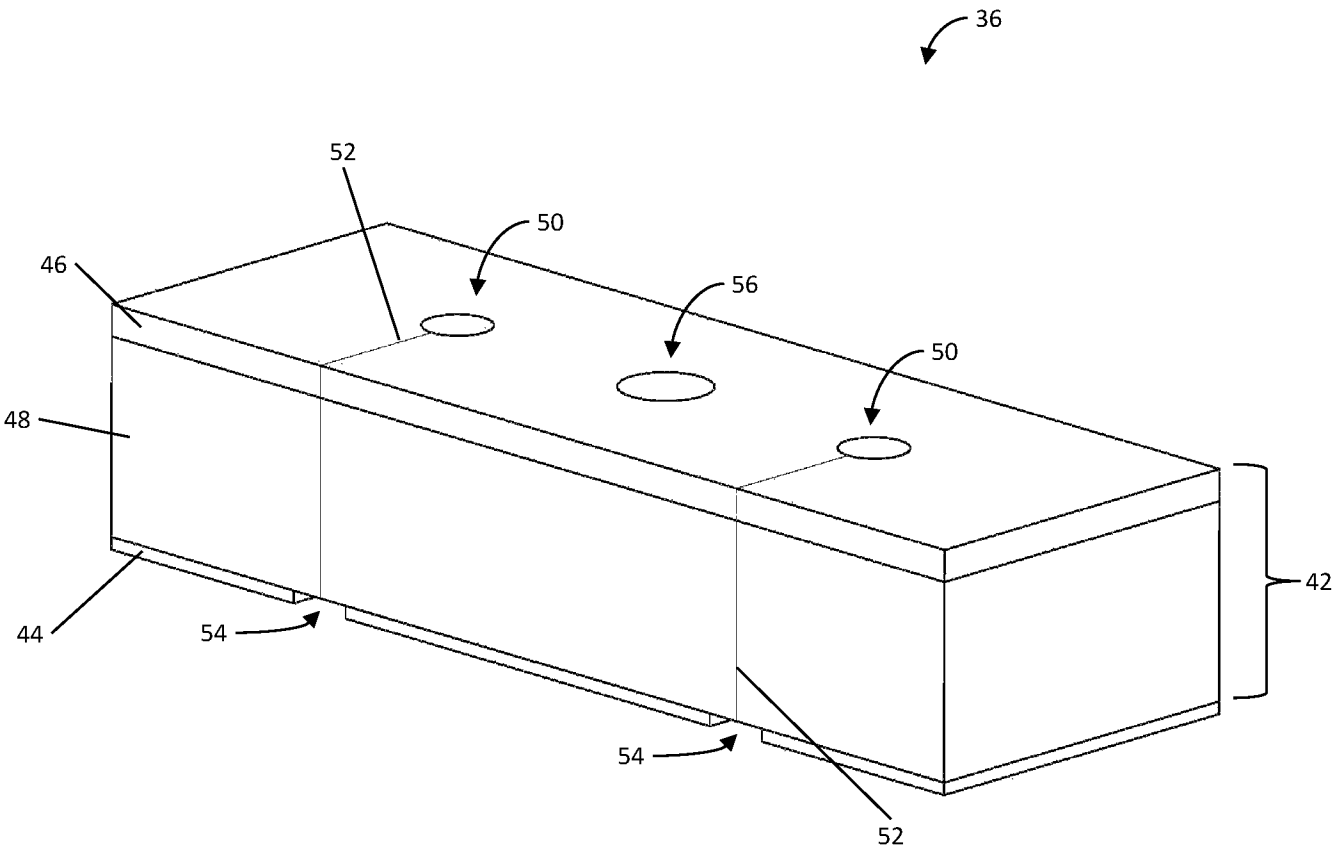
FIG. 3 is an axonometric view of the weight stack isolator.
Figure 4:
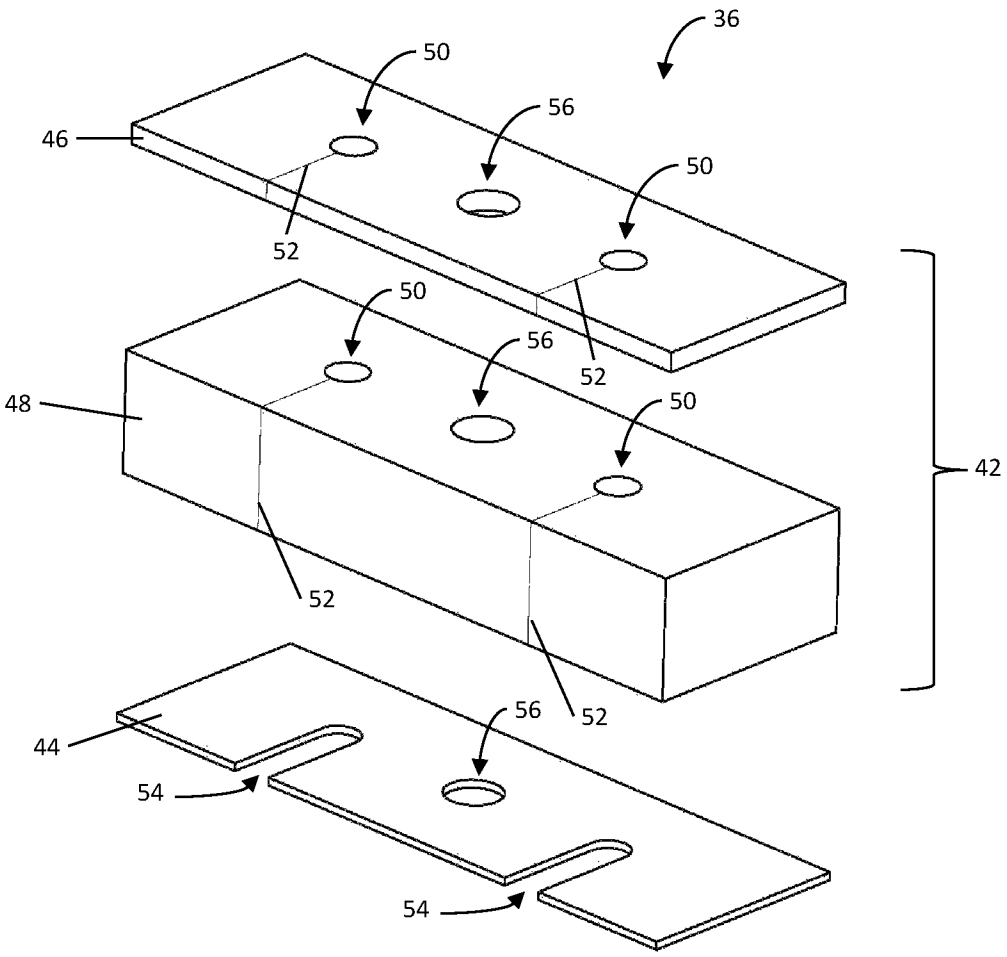
FIG. 4 is an exploded view of the weight stack isolator.

FIGS. 2, 3 and 4 better illustrate the weight stack isolator 36. The weight stack isolator 36 has generally planar top, bottom and side surfaces, and has a rectangular footprint that is generally similar to that of the bottommost plate 38 of the weight stack 32. The weight stack isolator 36 comprises an impact damper 42 and a bearing plate 44. The bearing plate 44 underlies the impact damper 42 and may be adhered thereto. During use, the weight stack isolator 36 is positioned under the bottommost plate 38 of the weight stack 32 and surrounds a section of the guide rails 30 to removably secure the weight stack isolator 36 to the selectorized machine 20 under the weight stack 32.

The impact damper 42 comprises a plurality of stacked layers that may be adhered together, including an impact layer 46 and a damping layer 48. The impact layer 46 overlies the damping layer 48 and protects the damping layer 48 from being directly impacted by the weight stack 32. The impact layer 46 is formed of resilient rubber, such as recycled rubber. The damping layer 48, which underlies the impact layer 46, absorbs or dampens noise and vibration caused by impacts from the weight stack 32 during use. The damping layer 48 is formed of a resilient material with a low dynamic modulus.

The impact damper 42 has a plurality of rail voids 50 therein for receiving the guide rails 30 of the selectorized machine 20. Each of the rail voids 50 is a cutout or through-hole in the impact damper 42 that is sized to receive a corresponding one of the guide rails 30, and each of the rail voids 50 extends through both the impact layer 46 and the damping layer 48. The rail voids 50 are laterally spaced apart and cylindrically shaped, i.e. each of the rail voids 50 has a circular horizontal cross-section. It will however be appreciated that in other embodiments, each of the rail voids 50 may have an oval, square, rectangular, oblong or otherwise shaped horizontal cross-section. The impact damper 42 further has a plurality of parallel and planar slits 52 provided therein. Each of the slits 52 extends inwardly from the same side of an outer perimeter of the impact damper 42 to a corresponding one of the rail voids 50 and extends through both the impact layer 46 and the damping layer 48. As further described below, the impact damper 42 is resiliently flexible to permit the guide rails 30 to pass through the slits 52 and into the rail voids 50.

The bearing plate 44 has a similar footprint to that of the impact damper 42 and has a plurality of plate voids 54 therein for receiving the guide rails 30 of the selectorized machine 20. Each of the plate voids 54 underlies and is in alignment with one of the rail voids 50 and one of the slits 52 in the impact damper 42. As illustrated in FIG. 4, each of the plate voids 54 is an elongated cutout or slot extending inwardly from an outer perimeter of the bearing plate 44. Each of the plate voids 54 is sized to receive the corresponding guide rail 30, and each of the plate voids 54 has a generally rectangular footprint ending in a semi-circular arch opposite the outer perimeter of the bearing plate 44. The plate voids 54 are laterally spaced apart and extend inwardly from the same side of the outer perimeter of the bearing plate 44. Each of the plate voids 54 has a width greater than that of the corresponding guide rail 30, to permit the guide rail 30 to be received in the plate void 54. The semi-circular arch at the end of each of the plate voids 54 has a curvature similar to that of the corresponding guide rail 30.

The bearing plate 44 is rigid and formed of metal, such as steel, or other rigid material. During use, the bearing plate 44 rest on the frame 22 of the selectorized machine 20 and supports the impact damper 42 above it to spread impacts from the weight stack 32 across the impact damper 42. Spreading the impact across the impact damper 42 can help to reduce wear and tear on the impact damper 42 and can help to ensure that the impact damper 42 operates within a designed compression range. Operating the impact damper 42 within the designed compression range and reducing wear and tear on the impact damper 42 can help to ensure that the weight stack isolator 36 provides a desired level of damping and can help to increase the useable life of the weight stack isolator 36.

In this embodiment, the weight stack isolator 36 has a selector rod void 56 therein for receiving the selector rod 28 of the selectorized machine 20. The necessity, location and shape of the selector rod void 56 of course depends on the configuration of the selectorized machine with which the weight stack isolator is intended to be used. For the selectorized machine 20 of FIG. 1, the selector rod void 56 is located between the rail voids 50 in the impact damper 42 and between the plate voids 54 in the bearing plate 44. The selector rod void 56 is cylindrically shaped and extends through both the impact damper 42 and the bearing plate 44. In other embodiments, the selector rod void 56 may be otherwise shaped and may extend only partway through the weight stack isolator 36. As will be appreciated, the selector rod void 56 may only be necessary in embodiments where the weight stack isolator 36 underlies the selector rod 28 and the selector rod 28 extends below the weight stack 32, or extends below the portion of the weight stack 32 overlying the weight stack isolator 36. Nevertheless, the selector rod void 56 can be included in further embodiments to improve flexibility of the weight stack isolator 36, to facilitate mass production and/or to achieve a desired level of damping.

As described above, the weight stack isolator 36 is adapted for retrofitting to an existing selectorized machine 20. That is, the selectorized machine 20 may be originally assembled with limited or no noise and vibration damping and thereafter the weight stack isolator 36 can be installed on the selectorized machine 20 to absorb or dampen noise and vibration caused by impacts from the weight stack 32 during use.

To install the weight stack isolator 36 on the selectorized machine 20, the entire weight stack 32 is engaged with the selector rod 28 and then raised using the exercise feature 24, the cable and pulley system 26 and the selector rod 28. Typically, this involves inserting the selector pin 40 through the bottommost plate 38 of the weight stack 32 and through the selector rod 28 and then pulling on the exercise feature 24 with one or more persons. However, those skilled in the art will appreciate that other methods for selectively engaging and raising the weight stack 32 can be used depending on the configuration of the selectorized machine 20.

Once the weight stack 32 has been raised, the slits 52 of the weight stack isolator 36 are aligned with the guide rails 30 under the weight stack 32 and the weight stack isolator 36 is forcibly pressed against the guide rails 30. As the guide rails 30 press against the slits 52, the impact damper 42 deforms to permit the guide rails 30 to pass through the slits 52 and into the rail voids 50 in the impact damper 42, as well as into the underlying plate voids 54 in the bearing plate 44. Receiving the guide rails 30 in the voids 50, 54 of the weight stack isolator 36 positions the weight stack isolator 36 under the weight stack 32. Once the guide rails 30 are received in the rail voids 50 and the plate voids 54, the impact damper 42 returns to its original shape and surrounds a section of the guide rails 30 to secure the weight stack isolator 36 to the selectorized machine 20 under the weight stack 32. If necessary, the weight stack isolator 36 can then be lowered on the guide rails 30 until it is supported by the frame 22, directly or indirectly, and the weight stack 32 can be lowered until it is resting on the weight stack isolator 36. As will be appreciated, the weight stack isolator 36 can be removed from the selectorized machine 20 by reversing this procedure.

Figure 5:
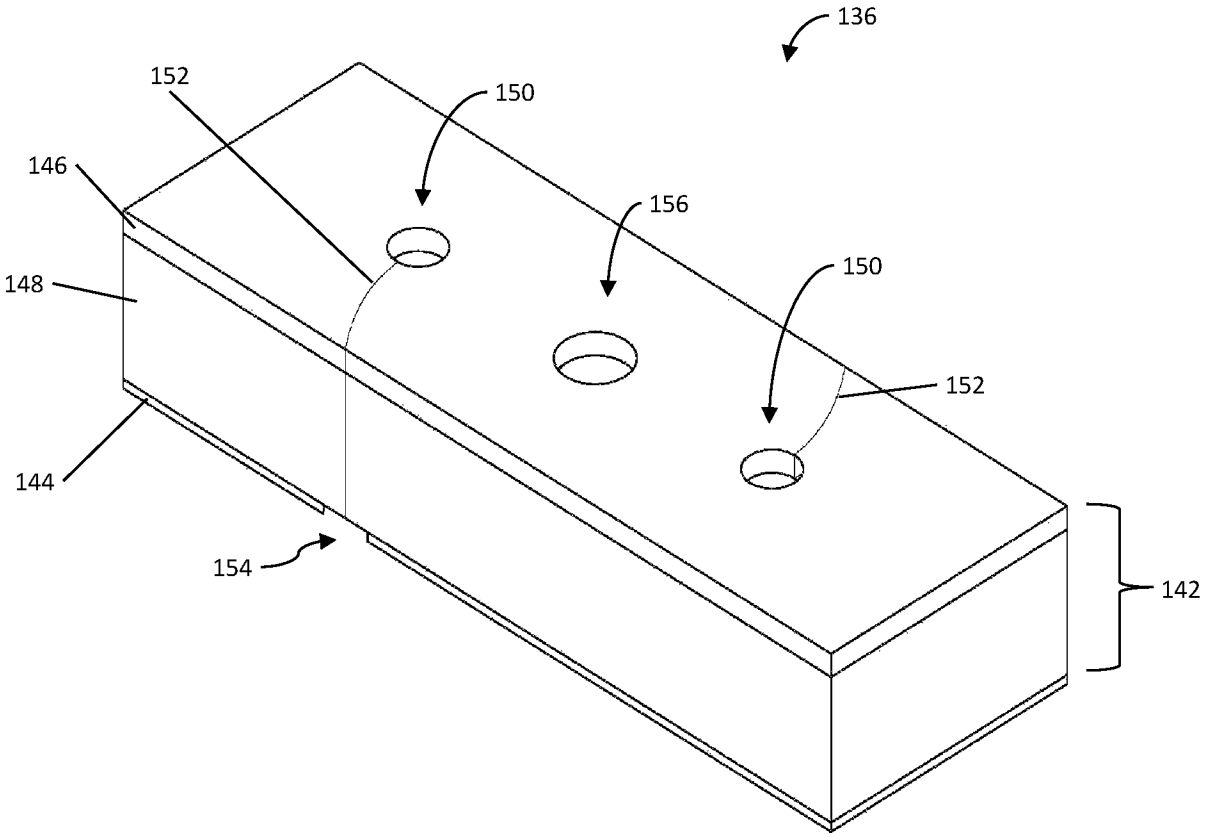
FIG. 5 is an axonometric view of another weight stack isolator.
Figure 6:
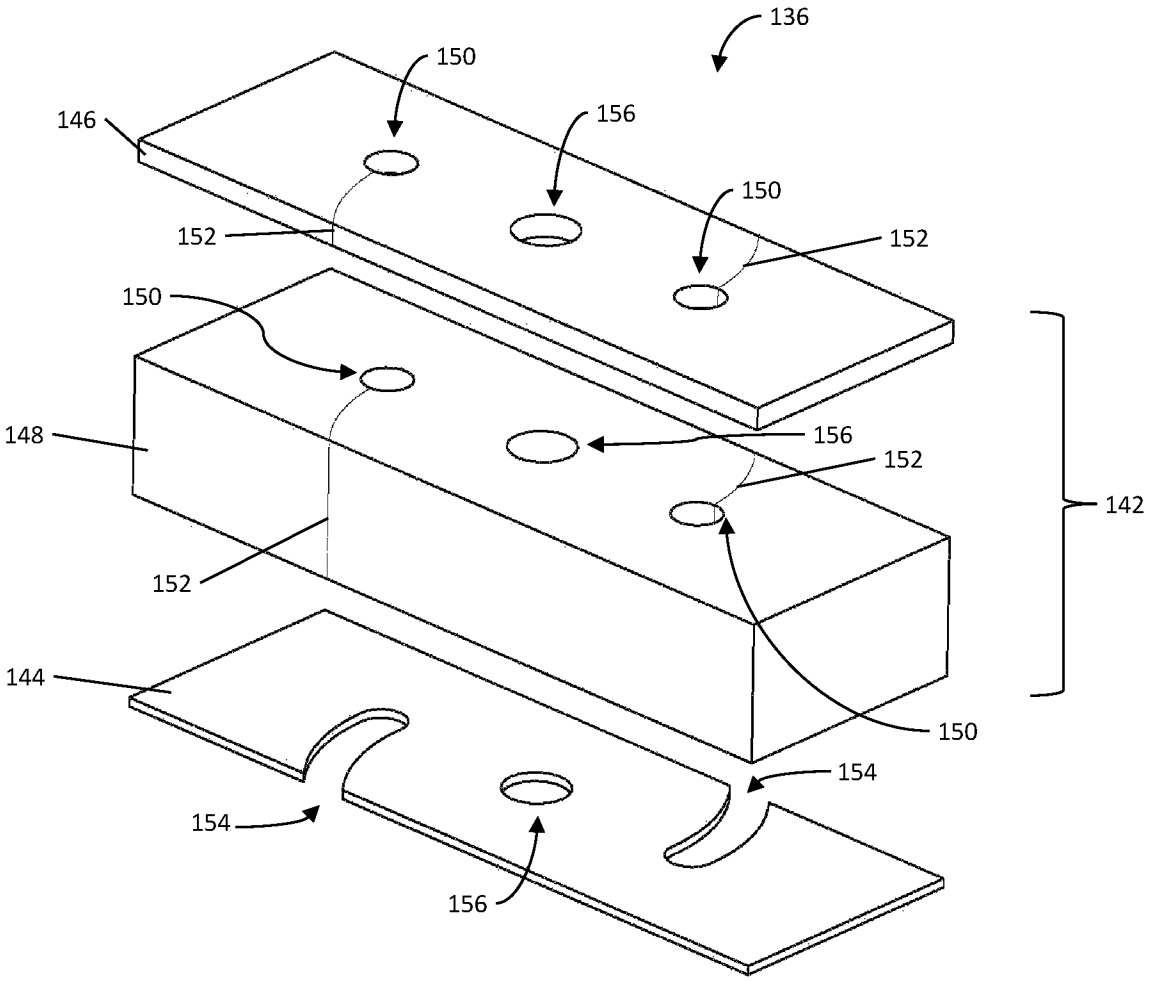
FIG. 6 is an exploded view of the weight stack isolator of FIG. 5.

FIGS. 5 and 6 illustrate another embodiment of a weight stack isolator generally identified by reference character 136. The weight stack isolator 136 is similar to the weight stack isolator 36 and like elements are identified by like reference characters, incremented by 100. Similar to weight stack isolator 36, the weight stack isolator 136 is designed to be retrofitted to the selectorized machine 20. In this embodiment, the weight stack isolator 136 is configured to be forcibly rotated to install the weight stack isolator 136 on the selectorized machine 20, as further described below.

The weight stack isolator 136 has generally planar top, bottom and side surfaces, and has a rectangular footprint that is generally similar to that of the bottommost plate 38 of the weight stack 32. The weight stack isolator 136 comprises an impact damper 142 and a bearing plate 144. The bearing plate 144 underlies the impact damper 142 and may be adhered thereto. During use, the weight stack isolator 136 is positioned under the bottommost plate 38 of the weight stack 32 and surrounds a section of the guide rails 30 to removably secure the weight stack isolator 136 to the selectorized machine 20 under the weight stack 32.

The impact damper 142 comprises a plurality of stacked layers that may be adhered together, including an impact layer 146 and a damping layer 148. The impact layer 146 overlies the damping layer 148 and protects the damping layer 148 from being directly impacted by the weight stack 32. The impact layer 146 is formed of resilient rubber, such as recycled rubber. The damping layer 148, which underlines the impact layer 146, absorbs or dampens noise and vibration caused by impacts from the weight stack 32 during use. The damping layer 148 is formed of a resilient material with a low dynamic modulus.

The impact damper 142 has a plurality of rail voids 150 therein for receiving the guide rails 30 of the selectorized machine 20. Each of the rail voids 150 is a cutout or through-hole in the impact damper 142 that is sized to receive a corresponding one of the guide rails 30 and each of the rail voids 150 extends through both the impact layer 146 and the damping layer 148. The rail voids 150 are laterally spaced apart and cylindrically shaped, i.e. each of the rail voids 150 has a circular horizontal cross-section. It will however be appreciated that in other embodiments, each of the rail voids 150 may have an oval, square, rectangular, oblong or otherwise shaped horizontal cross-section. The impact damper 142 further has a plurality of arcuate slits 152 provided therein and extending from opposite sides of the weight stack isolator 136. Each of the slits 152 extends inwardly from an outer perimeter of the impact damper 142 to a corresponding one of the rail voids 150 and extends through both the impact layer 146 and the damping layer 148. As further described below, the impact damper 142 is resiliently flexible to permit the guide rails 30 to pass through the slits 152 and into the rail voids 150.

The bearing plate 144 has a similar footprint to that of the impact damper 142 and has a plurality of plate voids 154 therein for receiving the guide rails 30 of the selectorized machine 20. Each of the plate voids 154 underlies and is in alignment with one of the rail voids 150 and one of the slits 152 in the impact damper 142. As illustrated in FIG. 6, each of the plate voids 154 is an elongated cutout or slot extending inwardly from an outer perimeter of the bearing plate 144. Each of the plate voids 154 is sized to receive the corresponding guide rail 30, and each of the plate voids 154 has a generally arcuate footprint ending in a semi-circular arch opposite the outer perimeter of the bearing plate 144. The plate voids 154 are laterally spaced apart and extend at an angle from opposite sides of the outer perimeter of the bearing plate 144. Each of the plate voids 154 has a width greater than that of the corresponding guide rail 30, to permit the guide rail 30 to be received in the plate void 154, and each semi-circular arch at the end of the plate voids 154 has a curvature similar to that of the corresponding guide rail 30.

The bearing plate 144 is rigid and formed of metal, such as steel, or other rigid material. During use, the bearing plate 144 rest on the frame 22 of the selectorized machine 20 and supports the impact damper 142 above it to spread impacts from the weight stack 32 across the impact damper 142. Spreading the impact across the impact damper 142 can help to reduce wear and tear on the impact damper 142 and can help to ensure that the impact damper 142 operates within a designed compression range. Operating the impact damper 142 within the designed compression range and reducing wear and tear on the impact damper 142 can help to ensure that the weight stack isolator 136 provides a desired level of damping and can help to increase the useable life of the weight stack isolator 136.

In this embodiment, the weight stack isolator 136 has a selector rod void 156 therein for receiving the selector rod 28 of the selectorized machine 20. The selector rod void 156 is the same as the selector rod void 56 described above.

As described above, weight stack isolator 136 is adapted for retrofitting to an existing selectorized machine 20. That is, the selectorized machine 20 may be originally assembled with limited or no noise and vibration damping and thereafter the weight stack isolator 136 can be installed on the selectorized machine 20 to absorb or dampen noise and vibration caused by impacts from the weight stack 32 during use.

To install the weight stack isolator 136 on the selectorized machine 20, the entire weight stack 32 is engaged with the selector rod 28 and then raised using the exercise feature 24, the cable and pulley system 26 and the selector rod 28. Typically, this involves inserting the selector pin 40 through the bottommost plate 38 of the weight stack 32 and through the selector rod 28 and then pulling on the exercise feature 24 with one or more persons. However, those skilled in the art will appreciate that other methods for selectively engaging and raising the weight stack 32 can be used depending on the configuration of the selectorized machine 20.

Once the weight stack 32 has been raised, the weight stack isolator 136 is positioned under the weight stack 32 in a first orientation intermediate the guide rails 30 of the selectorized machine 20. In the first orientation, the slits 152 of the weight stack isolator 136 are aligned with the guide rails 30 such that the guide rails 30 press against the slits 152 when the weight stack isolator 136 is rotated in a generally horizontal plane. The weight stack isolator 136 is then forcibly rotated in the generally horizontal plane to forcibly press the guide rails 30 against the slits 152. As the guide rails 30 press against the slits 152 of the weight stack isolator 136, the impact damper 142 deforms to permit the guide rails 30 to pass through the slits 152 and into the rail voids 150 in the impact damper 142, as well as into the underlying plate voids 154 in the bearing plate 144. The weight stack isolator 136 is forcibly rotated until the weight stack isolator 136 is positioned in a second orientation, where the weight stack isolator 136 bridges the guide rails 30 and where the guide rails 30 are received in the rail voids 150 and the plate voids 154. Once the guide rails 30 are received in the rail voids 150 and the plate voids 154, the impact damper 142 returns to its original shape and surrounds a section of the guide rails 30 to removably secure the weight stack isolator 136 to the selectorized machine 20 under the weight stack 32. If necessary, the weight stack isolator 136 can then be lowered on the guide rails 30 until it is supported by the frame 22, directly or indirectly, and the weight stack 32 can be lowered until it is resting on the weight stack isolator 136. As will be appreciated, the weight stack isolator 136 can be removed from the selectorized machine 20 by reversing this procedure.

Figure 7:
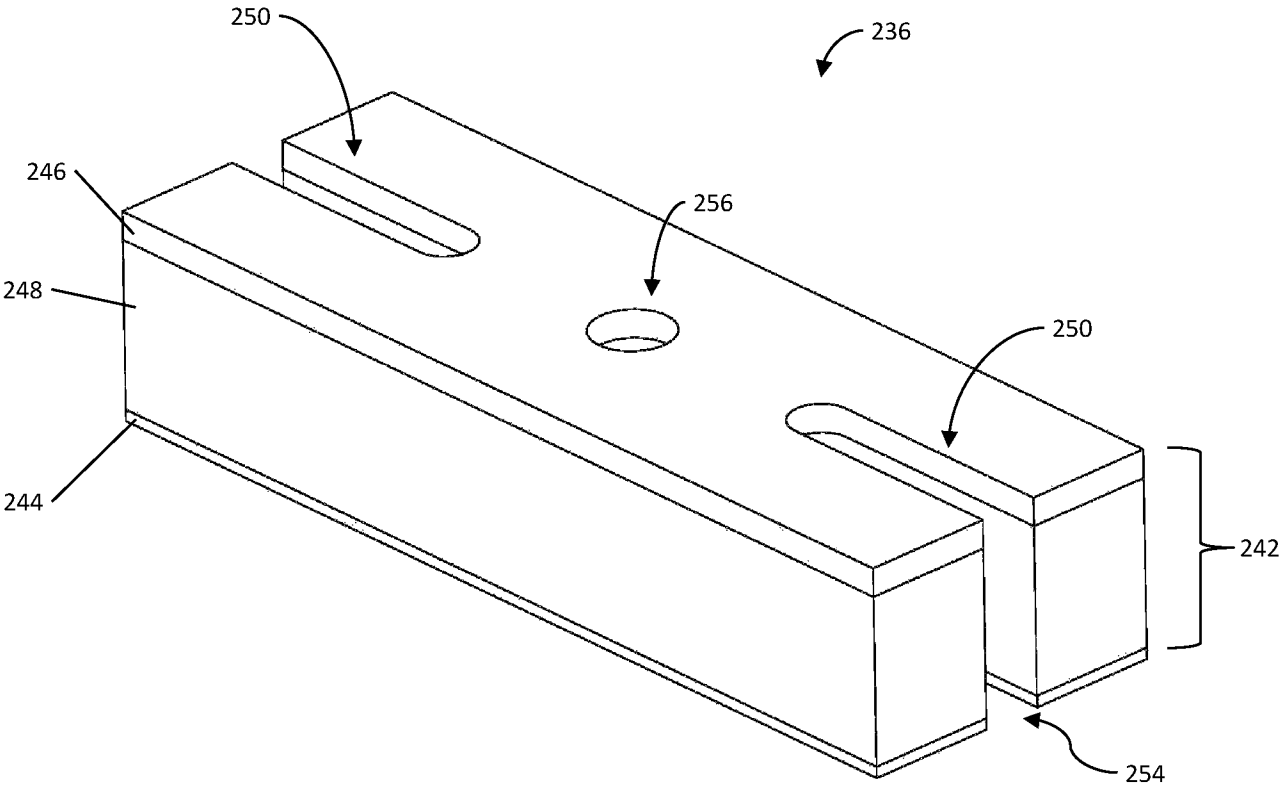
FIG. 7 is an axonometric view of another weight stack isolator.
Figure 8:
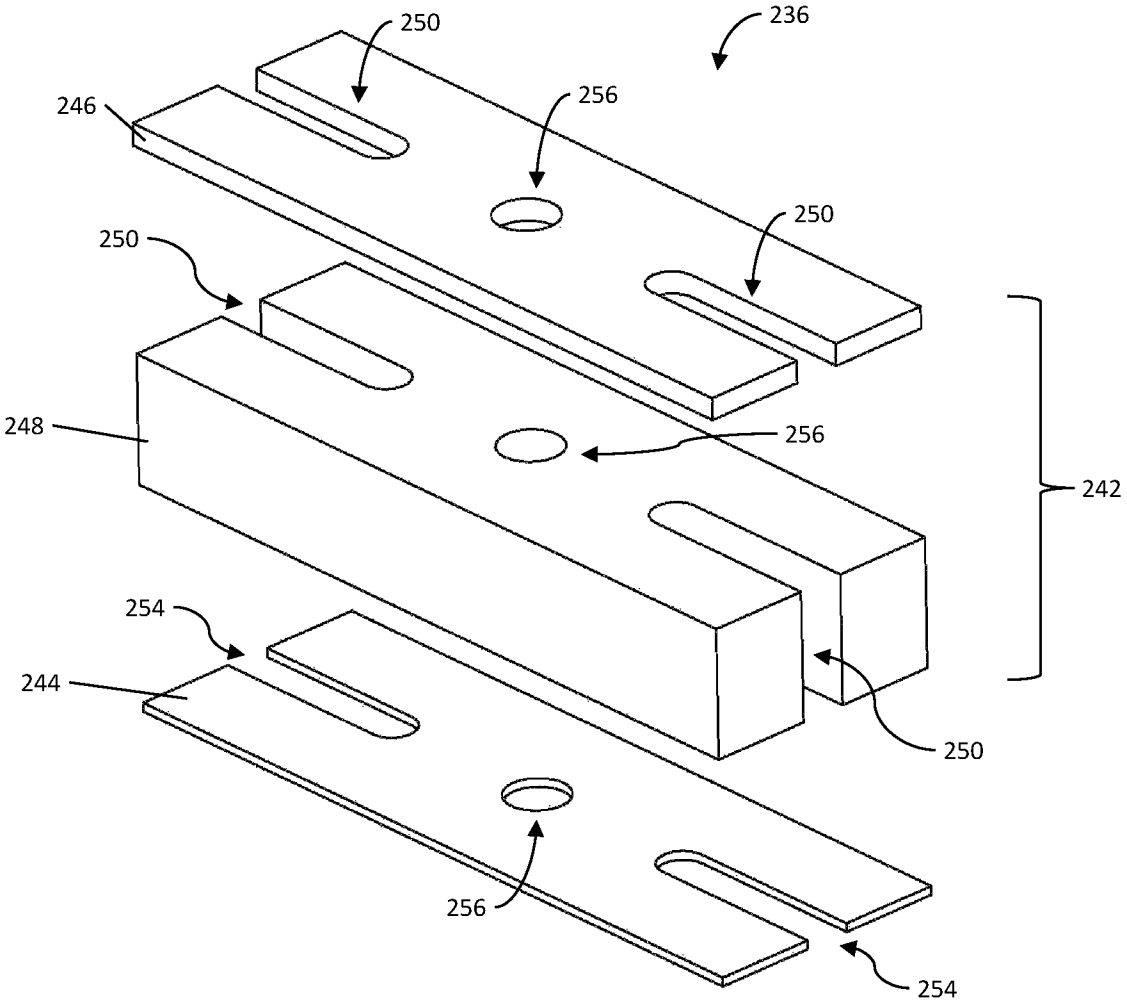
FIG. 8 is an exploded view of the weight stack isolator of FIG. 7.

FIGS. 7 and 8 illustrate another embodiment of a weight stack isolator generally identified by reference character 236. The weight stack isolator 236 is similar to the weight stack isolator 36 and like elements are identified by like reference characters, incremented by 200. Similar to the weight stack isolator 36, the weight stack isolator 236 is designed to be retrofitted to the selectorized machine 20. In this embodiment, the weight stack isolator 236 is configured to be rotated in a generally vertical plane to install the weight stack isolator 236 on the selectorized machine 20, as further described below.

The weight stack isolator 236 has generally planar top, bottom and side surfaces, and has a rectangular footprint that is generally similar to that of the bottommost plate 38 of the weight stack 32. The weight stack isolator 236 comprises an impact damper 242 and a bearing plate 244. The bearing plate 244 underlies the impact damper 242 and may be adhered thereto. During use, the weight stack isolator 236 is positioned under the bottommost plate 38 of the weight stack 32 and partially surrounds a section of the guide rails 30 to removably secure the weight stack isolator 236 to the selectorized machine 20 under the weight stack 32.

The impact damper 242 comprises a plurality of layers that may be adhered together, including an impact layer 246 and a damping layer 248. The impact layer 246 overlies the damping layer 248 and protects the damping layer 248 from being directly impacted by the weight stack 32. The impact layer 246 is formed of resilient rubber, such as recycled rubber. The damping layer 248 underlies the impact layer 246 and absorbs or dampens noise and vibrations caused by impacts from the weight stack 32 during use. The damping layer 248 is formed of a resilient material with a low dynamic modulus.

The impact damper 242 has a plurality of rail voids 250 therein for receiving the guide rails 30 of the selectorized machine 20. As illustrated in FIGS. 7 and 8, each of the rail voids 250 is an elongated cutout or slot extending inwardly from an outer perimeter of the impact damper 242. Each of the rail voids 250 extends inwardly from the outer perimeter of the impact damper 242 and towards the center of the weight stack isolator 236. Each of the rail voids 250 is sized to receive a corresponding one of the guide rails 30 and extends through both the impact layer 246 and the damping layer 248. As illustrated in FIGS. 7 and 8, each of the rail voids 250 has a generally rectangular footprint ending in a semi-circular arch, opposite the outer perimeter of the impact damper 242. The rail voids 250 are laterally spaced apart and extend from opposite sides of the outer perimeter of the impact damper 242. Each of the rail voids 250 has a width greater than that of the corresponding guide rail 30, to permit the guide rail 30 to be received in the rail void 250. The semi-circular arch at the end of each of the rail voids 250 has a curvature similar to that of the corresponding guide rail 30.

The bearing plate 244 has a similar footprint to that of the impact damper 242 and has a plurality of plate voids 254 therein for receiving the guide rails 30 of the selectorized machine 20. Each of the plate voids 254 underlies and is in alignment with one of the rail voids 250 in the impact damper 242. As illustrated in FIG. 8, each of the plate voids 254 is an elongated cutout or slot extending inwardly from an outer perimeter of the bearing plate 244. Each of the plate voids 254 extends inwardly from the outer perimeter of the bearing plate 254 and towards the center of the weight stack isolator 236, similar to the rail voids 250. Each of the plate voids 254 is sized to receive the corresponding guide rail 30. As illustrated in FIG. 8, each of the plate voids 254 has a generally rectangular footprint ending in a semi-circular arch opposite the outer perimeter of the bearing plate 244. The plate voids 254 are laterally spaced apart and extend from opposite sides of the outer perimeter of the bearing plate 244. Each of the plate voids 254 has a width greater than that of the corresponding guide rail 30, to permit the guide rail 30 to be received in the plate void 254. The semi-circular arch at the end of each of the plate voids 254 has a curvature similar to that of the corresponding guide rail 30.

The bearing plate 244 is rigid and formed of metal, such as steel, or other rigid material. During use, the bearing plate 244 rest on the frame 22 of the selectorized machine 20 and supports the impact damper 242 above it to spread impacts from the weight stack 32 across the impact damper 242. Spreading the impact across the impact damper 242 can help to reduce wear and tear on the impact damper 242 and can help to ensure that the impact damper 242 operates within a designed compression range. Operating the impact damper 242 within the designed compression range and reducing wear and tear on the impact damper 242 can help to ensure that the weight stack isolator 236 provides a desired level of damping and can help to increase the useable life of the weight stack isolator 236.

In this embodiment, the weight stack isolator 236 has a selector rod void 256 therein for receiving the selector rod 28 of the selectorized machine 20. The selector rod void 256 is the same as the selector rod void 56 described.

As described above, the weight stack isolator 236 is adapted for retrofitting to an existing selectorized machine 20. That is, the selectorized machine 20 may be originally assembled with limited or no noise and vibration damping and thereafter the weight stack isolator 236 can be installed on the selectorized machine 20 to absorb or dampen noise and vibration caused by impacts from the weight stack 32 during use.

To install the weight stack isolator 236 on the selectorized machine 20, the entire weight stack 32 is engaged with the selector rod 28 and then raised using the exercise feature 24, the cable and pulley system 26 and the selector rod. Typically, this involves inserting the selector pin 40 through the bottommost plate 38 of the weight stack 32 and through the selector rod 28 and then pulling on the exercise feature 24 with one or more persons. However, those skilled in the art will appreciate that other methods for selectively engaging and raising the weight stack can be used depending on the configuration of the selectorized machine.

Once the weight stack 32 has been raised, the weight stack isolator 236 is positioned under the weight stack 32 in a vertical orientation between the guide rails 30 and then rotated into a horizontal orientation, with the bearing plate 244 on the bottom, such that the guide rails 30 are received in the rail voids 250 in the impact damper 242 as well as in the underlying plate voids 254 in the bearing plate 244. When the guide rails 30 are received in the rail voids 250 and plate voids 254, the impact damper 242 partially surrounds a section of the guide rails 30 to removably secure the weight stack isolator 236 to the selectorized machine 20 under the weight stack 32. The weight stack isolator 236 can then be lowered on the guide rails 30 until it is supported by the frame 22, directly or indirectly, and the weight stack 32 can be lowered until it is resting on the weight stack isolator 236. As will be appreciated, the weight stack isolator 236 can be removed from the selectorized machine 20 by reversing this procedure.

Figure 9:
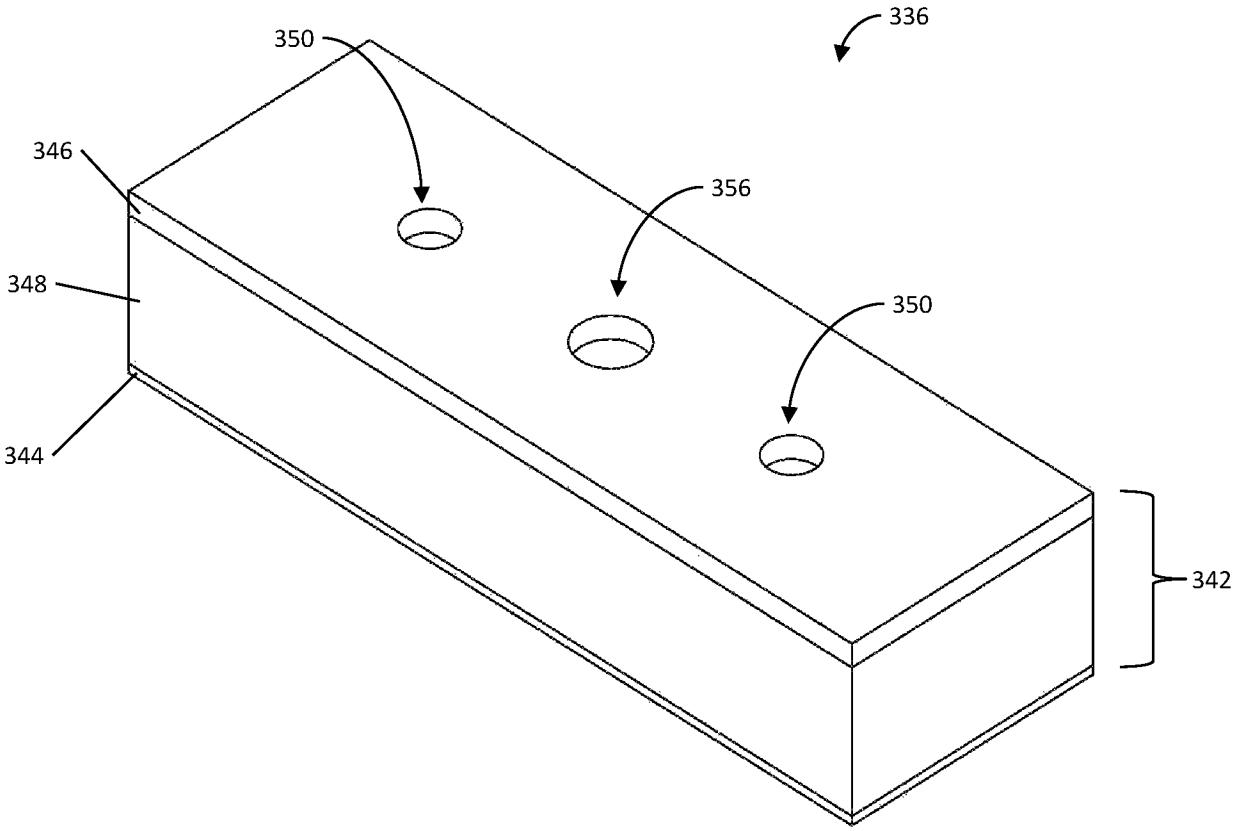
FIG. 9 is an axonometric view of another weight stack isolator.
Figure 10:
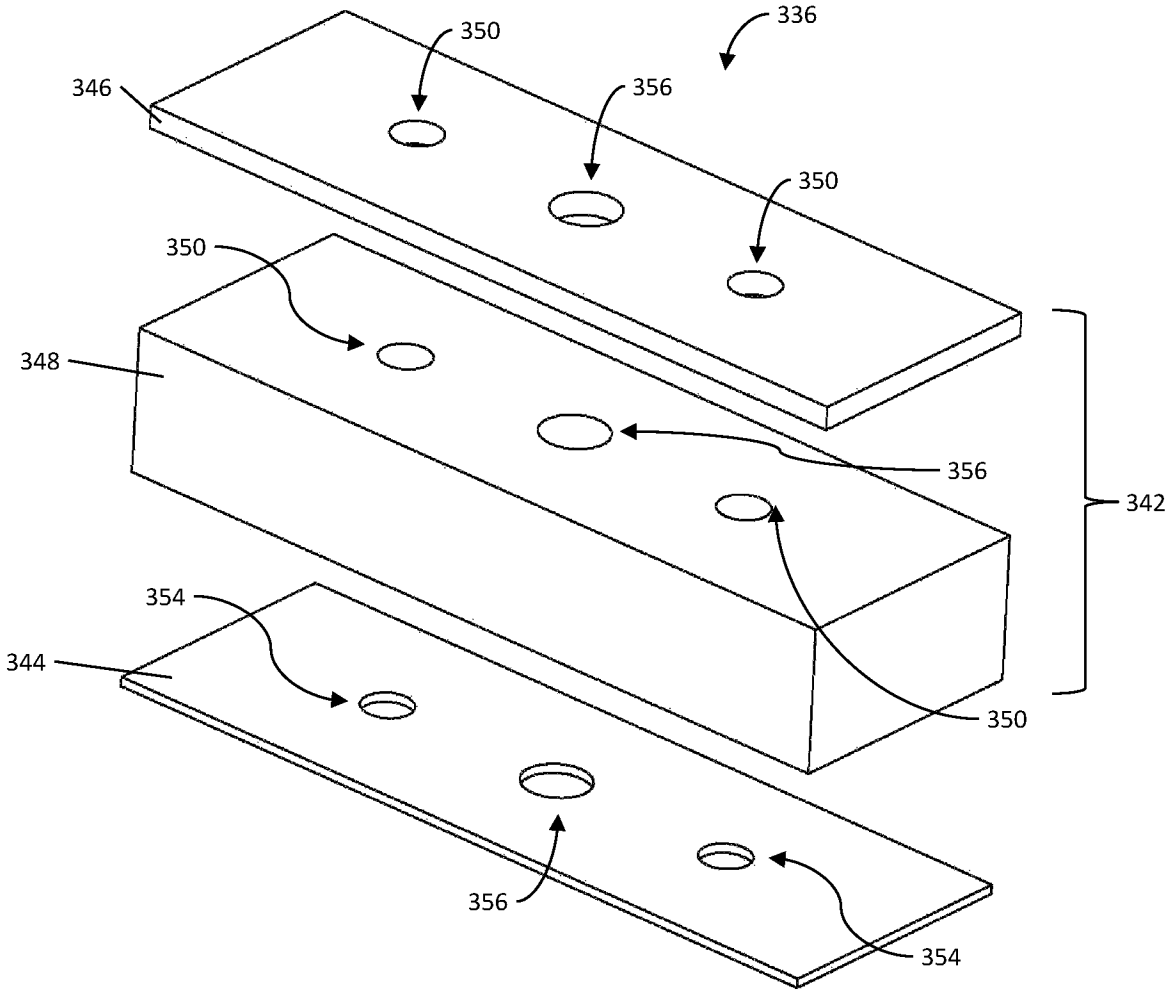
FIG. 10 is an exploded view of the weight stack isolator of FIG. 9.

FIGS. 9 and 10 illustrate another embodiment of a weight stack isolator generally identified by reference character 336. The weight stack isolator 336 is similar to the weight stack isolator 36 and like elements are identified by like reference characters, incremented by 300. In this embodiment, the weight stack isolator 336 is designed to be installed during assembly of the selectorized machine 20 and is fixedly secured under the weight stack 32.

The weight stack isolator 336 has generally planar top, bottom and side surfaces, and has a rectangular footprint that is generally similar to that of the bottommost plate 38 of the weight stack 32. The weight stack isolator 336 comprises an impact damper 342 and a bearing plate 344. The bearing plate 344 underlies the impact damper 342 and may be adhered thereto. During use, the weight stack isolator 336 is positioned under the bottommost plate 38 of the weight stack 32 and surrounds a section of the guide rails 30 to secure the weight stack isolator 336 to the selectorized machine 20 under the weight stack 32.

The impact damper 342 comprises a plurality of stacked layers that may be adhered together, including an impact layer 346 and a damping layer 348. The impact layer 346 overlies the damping layer 348 and protects the damping layer 348 from being directly impacted by the weight stack 32. The impact layer 346 is formed of resilient rubber, such as recycled rubber. The damping layer 348, which underlines the impact layer 346, absorbs or dampens noise and vibration caused by impacts from the weight stack 32 during use. The damping layer 348 is formed of a resilient material with a low dynamic modulus.

The impact damper 342 has a plurality of rail voids 350 therein for receiving the guide rails 30 of the selectorized machine 20. Each of the rail voids 350 is a cutout or through-hole in the impact damper 342 that is sized to receive a corresponding one of the guide rails 30 and each of the rail voids 350 extends through both the impact layer 346 and the damping layer 348. The rail voids 350 are laterally spaced apart and cylindrically shaped, i.e. each of the rail voids 350 has a circular horizontal cross-section. It will however be appreciated that in other embodiments, each of the rail voids 350 may have an oval, square, rectangular, oblong or otherwise shaped horizontal cross-section.

The bearing plate 344 has a similar footprint to that of the impact damper 342 and has a plurality of plate voids 354 therein for receiving the guide rails 30 of the selectorized machine 20. Each of the plate voids 354 underlies and is in alignment with one of the rail voids 350 in the impact damper 342. As illustrated in FIG. 10, each of the plate voids 354 is a cutout or through-hole that extends through the bearing plate 344. The plate voids 354 are laterally spaced apart and cylindrically shaped, i.e. each of the plate voids 354 has a circular horizontal cross-section. It will however be appreciated that in other embodiments, each of the plate voids 354 may have an oval, square, rectangular, oblong or otherwise shaped horizontal cross-section. Each of the plate voids 354 is sized to receive the corresponding guide rail 30, and has a diameter greater than that of the corresponding guide rail 30.

The bearing plate 344 is rigid and formed of metal, such as steel, or other rigid material. During use, the bearing plate 344 rest on the frame 22 of the selectorized machine 20 and supports the impact damper 342 above it to spread impacts from the weight stack 32 across the impact damper 342. Spreading the impact across the impact damper 342 can help to reduce wear and tear on the impact damper 342 and can help to ensure that the impact damper 342 operates within a designed compression range. Operating the impact damper 342 within the designed compression range and reducing wear and tear on the impact damper 342 can help to ensure that the weight stack isolator 336 provides a desired level of damping and can help to increase the useable life of the weight stack isolator 336.

In this embodiment, the weight stack isolator 336 has a selector rod void 356 therein for receiving the selector rod 28 of the selectorized machine 20. The selector rod void 356 is the same as the selector rod void 56 described above.

As described above, the weight stack isolator 336 is adapted to be installed during assembly of the selectorized machine 20. During this assembly, the weight stack isolator 336 is positioned under the bottommost plate 38 of the weight stack 32 with the guide rails 30 received in the rail voids 350 in the impact damper 342 as well as in the underlying plate voids 354 in the bearing plate 344. As a result, the impact damper 342 and the bearing plate 344 surround a section of the guide rails 30 to fixedly secure the weight stack isolator 336 under the weight stack 32. When the selectorized machine 20 is assembled, the weight stack isolator 336 is supported by the frame 22, directly or indirectly, and the weight stack 32 rests on the weight stack isolator 336.

Figure 11:
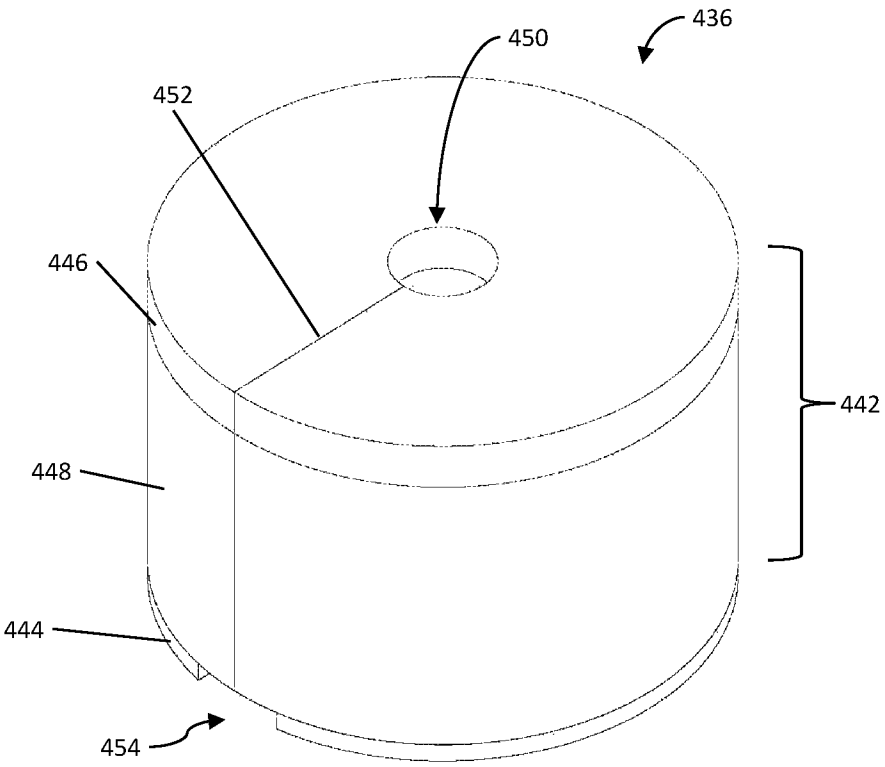
FIG. 11 is an axonometric view of another weight stack isolator.
Figure 12:
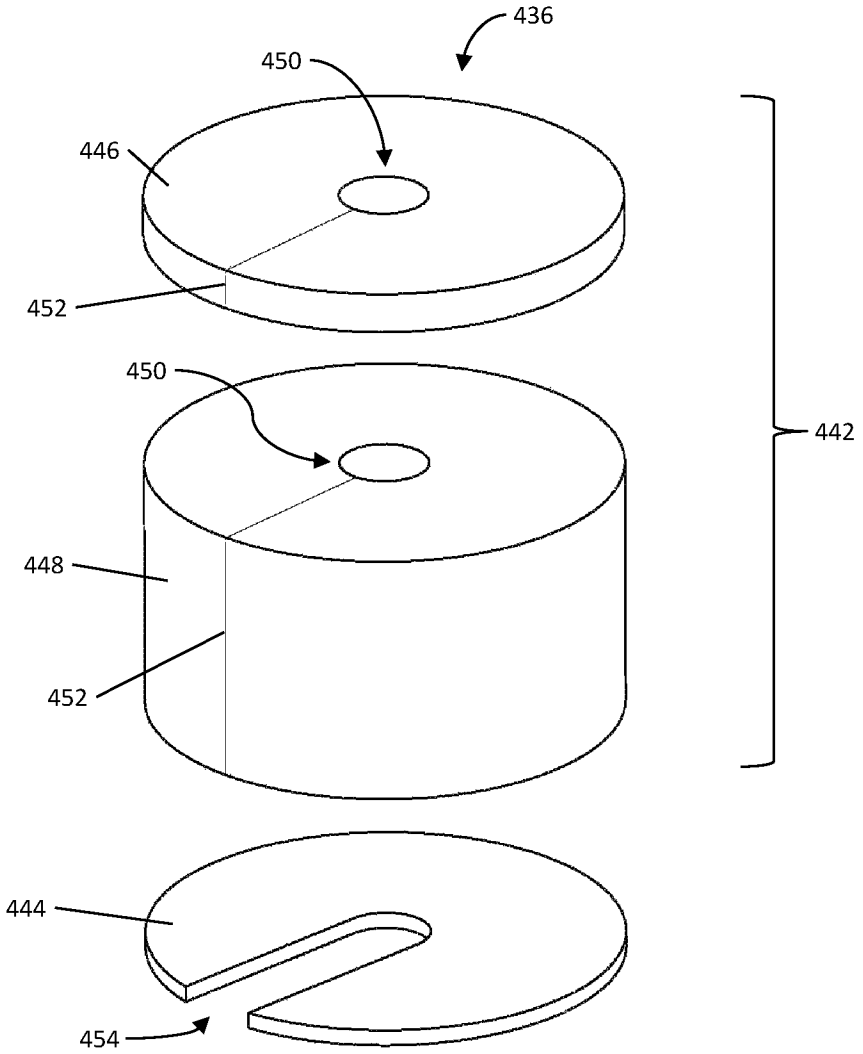
FIG. 12 is an exploded view of the weight stack isolator of FIG. 11.

FIGS. 11 and 12 illustrate another embodiment of a weight stack isolator generally identified by reference character 436. The weight stack isolator 436 is similar to the weight stack isolator 36 and like elements are identified by like reference characters, incremented by 400. Similar to weight stack isolator 36, the weight stack isolator 436 is designed to be retrofitted to the selectorized machine 20. In this embodiment, the weight stack isolator 436 is adapted to be removably secured to a single one of the guide rails 30 of the selectorized machine 20 and a weight stack isolator 436 is installed on each guide rail 30 of the selectorized machine 20.

The weight stack isolator 436 is cylindrically shaped with generally planar top and bottom surfaces. The weight stack isolator 436 comprises an impact damper 442 and a bearing plate 444. The bearing plate 444 underlies the impact damper 442 and may be adhered thereto. During use, the weight stack isolator 436 is positioned under the bottommost plate 38 of the weight stack 32 and surrounds a section of one of the guide rails 30 to removably secure the weight stack isolator 436 to the selectorized machine 20 under the weight stack 32.

The impact damper 442 comprises a plurality of stacked layers that may be adhered together, including an impact layer 446 and a damping layer 448. The impact layer 446 overlies the damping layer 448 and protects the damping layer 448 from being directly impacted by the weight stack 32. The impact layer 446 is formed of resilient rubber, such as recycled rubber. The damping layer 448, which underlines the impact layer 446, absorbs or dampens noise and vibration caused by impacts from the weight stack 32 during use. The damping layer 448 is formed of a resilient material with a low dynamic modulus.

The impact damper 442 has a rail void 450 therein for receiving one of the guide rails 30 of the selectorized machine 20. The rail void 450 is a cutout or through-hole in the impact damper 442 that is sized to receive the one of the guide rails 30 and the rail void 450 extends through both the impact layer 446 and the damping layer 448. The rail void 150 is cylindrically shaped, i.e. the rail void 450 has a circular horizontal cross-section. It will however be appreciated that in other embodiments, the rail void 450 may have an oval, square, rectangular, oblong or otherwise shaped horizontal cross-section. The impact damper 442 further has a radially extending slit 452 provided therein. The slit 452 extends radially from an outer perimeter of the impact damper 442 to the rail void 450. The slit 452 extends through both the impact layer 446 and the damping layer 448. As further described below, the impact damper 442 is resiliently flexible to permit the guide rail 30 to pass through the slit 452 and into the rail void 450.

The bearing plate 444 has a similar footprint to that of the impact damper 442 and has a plate void 454 therein for receiving one of the guide rails 30 of the selectorized machine 20. The plate void 454 underlies and is in alignment with the rail void 450 and the slit 452 in the impact damper 442. As illustrated in FIG. 12, the plate void 454 is an elongated cutout or slot extending radially inwardly from an outer perimeter of the bearing plate 444. The plate void 454 is sized to receive the corresponding guide rail 30, and the plate void 454 has a generally rectangular footprint ending in a semi-circular arch opposite the outer perimeter of the bearing plate 444. The plate void 454 has a width greater than that of the corresponding guide rail 30, to permit the guide rail 30 to be received in the plate void 454. The semi-circular arch at the end of the plate void 454 has a curvature similar to that of the corresponding guide rail 30.

The bearing plate 444 is rigid and formed of metal, such as steel, or other rigid material. During use, the bearing plate 444 rest on the frame 22 of the selectorized machine 20 and supports the impact damper 442 above it to spread impacts from the weight stack 32 across the impact damper 442. Spreading the impact across the impact damper 442 can help to reduce wear and tear on the impact damper 442 and can help to ensure that the impact damper 442 operates within a designed compression range. Operating the impact damper 442 within the designed compression range and reducing wear and tear on the impact damper 442 can help to ensure that the weight stack isolator 436 provides a desired level of damping and can help to increase the useable life of the weight stack isolator 436.

As described above, the weight stack isolator 436 is adapted for retrofitting to an existing selectorized machine 20. That is, the selectorized machine 20 may be originally assembled with limited or no noise and vibration damping and thereafter a plurality of the weight stack isolators 436 can be installed (one on each of the guide rails 30) to absorb or dampen noise and vibration caused by impacts from the weight stack 20 during use. The weight stack isolator 436 is installed and removed in the same way as the weight stack isolator 36, described above.

It will be appreciated by those skilled in the art that elements have generally similar footprints when their outer perimeters define horizontal two-dimensional areas with the same or nearly the same size and shape, disregarding any voids, slits or the like.

It will be appreciated by those skilled in the art that the materials and thicknesses of the various layers in the weight stack isolator will depend on the intended use and application of the weight stack isolator. For example, a weight stack isolator for use in heavy weight applications may have thicker layers or may have layers formed of stiffer or denser materials than those of a weight stack isolator for use in light weight applications. Additionally, it will be appreciated by those skilled in the art that by adjusting the thicknesses and materials of the various layers, the performance of the weight stack isolator can be modified and tailored depending on the intended use and application of the weight stack isolator. In some embodiments, the weight stack isolator may provide vibration isolation efficiencies of up to 99% and/or may provide over 40 dB of noise reduction.

In exemplary embodiments of the weight stack isolators shown and described above, the impact layer may have a thickness of 8 mm and may be formed of resilient rubber, such as recycled rubber. The material of the impact layer may have substantially the following properties: weight of approximately 77.1 kg per 9.3 $m^2$, wear hardness per DIN 53577 of approximately 4.0 MPa, Shore A hardness per DIN 53505 of 60 (+/−5), compression set per DIN 53517 of approximately 15%, abrasion per DIN 53516 of maximum 200 $mm^3$, tensile strength per EN ISO 1798 of approximately 1.5 $N/mm^2$, elongation at break per EN ISO 1798 of approximately 90%, coefficient of friction per EN 13893: 2002 of $\mu$=0.47 (safe), fire resistance per DIN EN 13501-1 of $E_{fl}$ (B2), light fastness per DIN EN 105-B02:1999-09 of 2-3, electrostatic properties per DIN EN 1815:1995-06 of 0.5 kV, remaining deformation per EN 433:1994-11 of 0.13 mm and reduction of impact sound pressure level ($\Delta L_w$) per DIN EN ISO 140-8:1998-03 of 18 dB.

In exemplary embodiments of the weight stack isolator shown and described above, the damping layer may have a thickness of 51 mm and may be formed of a low dynamic modulus elastomer. The material of the damping layer may have substantially the following properties: durometer of 10, weight of approximately 7 kg per 2 $m^2$, mechanical loss factor per DIN 53513 of 0.25, static E-modulus per DIN 53513 of 0.048 $N/mm^2$, dynamic E-modulus per DIN 53513 of 0.144 $N/mm^2$, static shear modulus per DIN 53513 of 0.04 $N/mm^2$, dynamic shear modulus per DIN 53513 of 0.09 $N/mm^2$, elongation at break per DIN 53455-6-4 of greater than 400%, resistance to strain of 0.011 $N/mm^2$, residual compression set per DIN EN ISO 1856 of less than 5%, tensile strength per DIN 53455-6-4 of greater than 0.35 $N/mm^2$, tear resistance per DIN ISO 34-1/A of 0.6 N/mm, rebound elasticity per DIN EN ISO 8370 of 50%, operating temperature of −30 to +70° C. and inflammability per EN ISO 11925-1 of Class E/EN13501-1. The damping layer may exhibit the characteristics set out in Table 1, below.

TABLE 1

| Damping Layer Characteristics (Exemplary Embodiment) | | |
|---|---|---|
| Load ($N/mm^2$) | Deflection (mm) | Natural Frequency (Hz) |
| 0.02 | 9.4 | 14.6 |
| 0.04 | 14.4 | 16.3 |
| 0.06 | 16.2 | 17.0 |

In exemplary embodiments of the weight stack isolator shown and described above, the bearing plate may have a thickness of 3 mm and may be formed of metal, such as steel.

Although the impact damper has been shown and described as comprising a plurality of stacked layers, including an impact layer and a damping layer. It will be appreciated that in some embodiments, the impact layer may be omitted. For example, in embodiments where the material of the damping layer is sufficiently resilient to withstand being directly impacted by the weight stack, the impact layer may be omitted and the weight stack may contact damping layer of the impact damper.

Although the weight stack isolator has been shown and described as being positioned under the bottommost plate of the weight stack, those skilled in the art will appreciate that in other embodiments the weight stack isolator may be positioned under only a portion of the weight stack. For example, the weight stack isolator may be positioned overlying the bottommost plate of the weight stack and under the remaining portion of the weight stack. In such embodiments, the bearing plate may be omitted from the weight stack isolator and the plate or plates of the weight stack underlying the weight stack isolator may provide support for the impact damper. It will be appreciated that only a portion of the weight stack needs to be raised to install the weight stack isolator in such embodiments.

Although the weight stack isolator has been shown and described as having a rectangular footprint that is generally similar to that of the bottommost plate of the weight stack, those skilled in the art will appreciate that in other embodiments the weight stack isolator may have a circular footprint or otherwise shaped footprint. For example, the weight stack isolator may have a footprint that is generally similar to an intermediate plate of the weight stack. Additionally, the weight stack isolator may have a footprint that is not generally similar any plate of the weight stack and may, for example, have a footprint that is larger or smaller than that of the weight stack.

Although the bearing plate has been described as having a similar footprint to that of the impact damper, those skilled in the art will appreciate that in other embodiments the bearing plate may have a footprint that differs in shape to that of the impact damper and may, for example, have a footprint that is larger or smaller than that of the impact damper. Additionally, in some embodiments the bearing plate may have a footprint that is similar to an underlying plate of the weight stack. In yet other embodiments, the bearing plate may be omitted entirely, as described above.

Although the slits in the impact damper have been shown as narrow in the accompanying drawings, those skilled in the art will appreciate that in other embodiments the slits may be wider to define gaps through which the rail guides pass. Additionally, in some embodiments the width of the slits may be generally equal to or larger than a width or diameter of the rail voids in the impact damper, such that the differentiation between the slits and the rail voids in the impact damper becomes immaterial and the combination of each slit and corresponding rail void can be considered a single void extending inwardly from the outer perimeter of the impact damper. Although the slits have been shown and described as extending from either the same side or opposite sides of the weight stack isolator, it will be appreciated that in other embodiments the slits may extend from adjacent sides of the weight stack isolator or from other combinations of sides.

Although the plate voids have been shown and described as extending from either the same side or opposite sides of the bearing plate, it will be appreciated that in other embodiments the plate voids may extend from adjacent sides of the bearing plate or from other combinations of sides.

Although each rail void and plate void has been shown and described as receiving one of the guide rails of the selectorized machine, it will be appreciated that in other embodiments each of the rail voids and the plate voids may be sized to receive a plurality of the guide rails. For example, the weight stack isolator may comprise a single rail void in the impact damper that is sized to simultaneously receive all of the guide rails of the selectorized machine.

Although embodiments have been described and are shown in the accompanying drawings, it will be appreciated by those skilled in the art that variations and modifications may be made without departing from the scope defined by the appended claims, and the scope of the claims should be given the broadest interpretation consistent with the description and drawings as a whole.

While this disclosure has been described as having exemplary designs, the present disclosure can be further modified within the spirit and scope of this disclosure. This application is therefore intended to cover any variations, uses, or adaptations of the disclosure using its general principles. Further, this application is intended to cover such departures from the present disclosure as come within known or customary practice in the art to which this disclosure pertains and which fall within the limits of the appended claims.

What is claimed is:

1. A weight stack isolator comprising:

an impact damper having at least one rail void therein, wherein the at least one rail void extends inwardly from an outer perimeter of the impact damper and is configured to receive at least one guide rail of a selectorized machine so that the impact damper partially surrounds a section of the at least one guide rail when received in the at least one rail void; and a bearing plate underlying the impact damper, the bearing plate having the at least one plate void therein extending inwardly from an outer perimeter of the bearing plate in alignment with the at least one rail void.

2. The weight stack isolator of claim 1, wherein the impact damper comprises a damping layer and an overlying impact layer.

3. The weight stack isolator of claim 2, wherein the damping layer and the impact layer have similar footprints.

4. The weight stack isolator of claim 2, wherein the impact layer is formed of resilient rubber.

5. The weight stack isolator of claim 4, wherein the impact layer has a weight of generally 77 kg per 9 $m^2$.

6. The weight stack isolator of claim 2, wherein the damping layer is formed of a low dynamic modulus elastomer and has a thickness of generally 50 mm.

7. The weight stack isolator of claim 6, wherein the damping layer has a weight of generally 7 kg per 2 $m^2$ and a durometer of generally 10.

8. The weight stack isolator of claim 1 wherein the weight stack isolator is configured to be positioned overlying the bottommost weight in the weight stack.

9. The weight stack isolator of claim 8, wherein the weight stack isolator has a generally similar footprint to that of the bottommost weight in the weight stack.

10. The weight stack isolator of claim 1, wherein the bearing plate is formed of steel.

11. The weight stack isolator of claim 1, wherein the at least one guide rail comprises a plurality of guide rails, and wherein the at least one rail void comprises a plurality of rail voids, each of the rail voids being configured to receive a corresponding one of the guide rails.

12. The weight stack isolator of claim 11, wherein the weight stack isolator is configured to be positioned overlying the bottommost weight in the weight stack.

13. The weight stack isolator of claim 1, wherein the weight stack isolator has a selector rod void therein extending at least partially therethrough for receiving a selector rod of the selectorized machine.

* * * * *